United States Patent [19]

Logie

[11] 4,388,783

[45] Jun. 21, 1983

[54] PREFABRICATED PARTITION ARRANGEMENT

[75] Inventor: Charles F. Logie, Spring Lake, Mich.

[73] Assignee: American Store Equipment Corporation, Muskegon, Mich.

[21] Appl. No.: 162,096

[22] Filed: Jun. 23, 1980

[51] Int. Cl.[3] ..... E04H 1/2

[52] U.S. Cl. ..... 52/36; 52/205; 52/206; 52/239; 49/379; 49/386; 297/14

[58] Field of Search ..... 52/238, 36, 239, 240, 52/205, 206; 49/386, 379; 16/184, 180; 297/14; 108/48

[56] References Cited

U.S. PATENT DOCUMENTS

| | | | |
|---|---|---|---|
| 1,377,298 | 5/1921 | Wheeler | 52/826 |
| 1,900,767 | 3/1933 | Ryan | 52/241 |
| 2,254,190 | 8/1941 | Ricken | 52/826 |
| 2,287,079 | 6/1942 | Anderson | 52/239 |
| 2,636,549 | 4/1953 | Geller | 108/48 |
| 2,776,029 | 1/1957 | Hult | 52/239 |
| 2,965,153 | 12/1960 | Purcell | 297/14 |
| 3,193,848 | 7/1965 | Levy | 108/48 |
| 3,194,362 | 7/1965 | Wargo | 52/239 |
| 3,348,346 | 10/1967 | Heim | 52/239 |
| 3,370,388 | 2/1968 | Dielman | 52/239 |
| 3,605,175 | 9/1971 | Wilson | 16/184 |
| 3,715,847 | 2/1973 | Straus | 52/239 |
| 3,820,296 | 6/1974 | Bebinger | 52/826 |
| 4,133,142 | 1/1979 | Dzus | 49/379 |

OTHER PUBLICATIONS

Sweet's Catalog File by McGraw-Hill published 1978, Sections 10.7/Gem last page, 10.7 Ge, p. 12 and 10.7/We, p. 11.

*Primary Examiner*—John E. Murtagh

*Attorney, Agent, or Firm*—Price, Heneveld, Huizenga & Cooper

[57] ABSTRACT

The specification discloses a prefabricated partition arrangement for fitting rooms and the like, comprising a pair of parallel, laterally spaced side panels having rearward edges thereof fastened to an interior wall of a building by a first pair of channels. A front panel with a door therein extends between the forward edges of the side panels and is connected therewith by a second pair of channels, thereby forming a sturdy, postless partition assembly.

51 Claims, 12 Drawing Figures

PREFABRICATED PARTITION ARRANGEMENT

BACKGROUND OF THE INVENTION

The present invention relates to prefabricated wall panels, and in particular to a partition arrangement for fitting rooms, booths, and other similar structures.

Prefabricated panels are interconnected to partition off selected areas of a building for use as dressing rooms, booths, rest room stalls, and the like. Corner posts or other similar structures are often used to interconnect adjacent partition panels, particularly in fitting rooms. These corner post arrangements are typically difficult to assemble and disassemble, and are considered by many to be esthetically unpleasant and have a temporary or makeshift appearance.

The panels for such partition arrangements are often constructed of a nonmetallic material, such as plywood, particle board, or the like. These panels often warp during use, such that when they are assembled with corner posts, the side edges of the panels present a very wavy, untidy appearance.

Door assemblies for partition arrangements have heretofore been equipped with specially designed hinges, which normally hold the door in an open position to indicate that the partitioned room is unoccupied. In such assemblies, the weight of the door itself is used to retain the door in the open position, such that the hinges must be carefully set. These hinges are relatively expensive, and require accurate mounting and periodic maintenance to insure proper operation.

Further, the doors in such partition arrangements are typically hung between the partition side edges which form the opening, in a manner very similar to a conventional door jam. The partition parts which are interconnected to form the opening must be carefully assembled to insure proper alignment and clearance so that the door will swing freely in the jam. If the panel members and/or doors become misaligned through usage or warpage, the hinges must be readjusted.

SUMMARY OF THE INVENTION

The present invention provides a prefabricated partition arrangement for fitting rooms and the like, which includes channels which extend along the side edges of the panels and interconnect the same to form a rigid, postless partition assembly. The channels are preferably asymmetrical, with one channel flange longer than the other, and with fasteners extending through only the larger of the channel flanges to draw the panel thereagainst, so as to present a neat, straight edge.

Another aspect of the present invention is to provide a seat for a prefabricated partition arrangement. The seat is hingedly connected with one of the panels, and includes a pedestal depending from a lower surface thereof at a point spaced apart from the hinge, such that the seat may be pivoted upwardly into a raised position for cleaning thereunder.

Yet another aspect of the present invention is to provide a flexible resilient tab for the partition door, which normally retains the door in a predetermined angular position with respect to the opening. The tab preferably has one end thereof mounted in a hinge bracket, and the other end captured in a corner formed by adjacent, intersecting panels to retain the door in a normal, partially open position.

Yet another aspect of the present invention is to provide a closure arrangement for the partition assembly, which includes a slab door hingedly mounted on the inside surface of the panels. The slab door overlaps the interior sides of the opening to provide a neat appearance without requiring accurate adjustment or alignment.

These and many other important advantages of the invention will be further understood and appreciated by reference to the following written specification, claims and appended drawings.

DETAILED DESCRIPTION OF THE PREFERRED EMBODIMENTS

Figure 1:
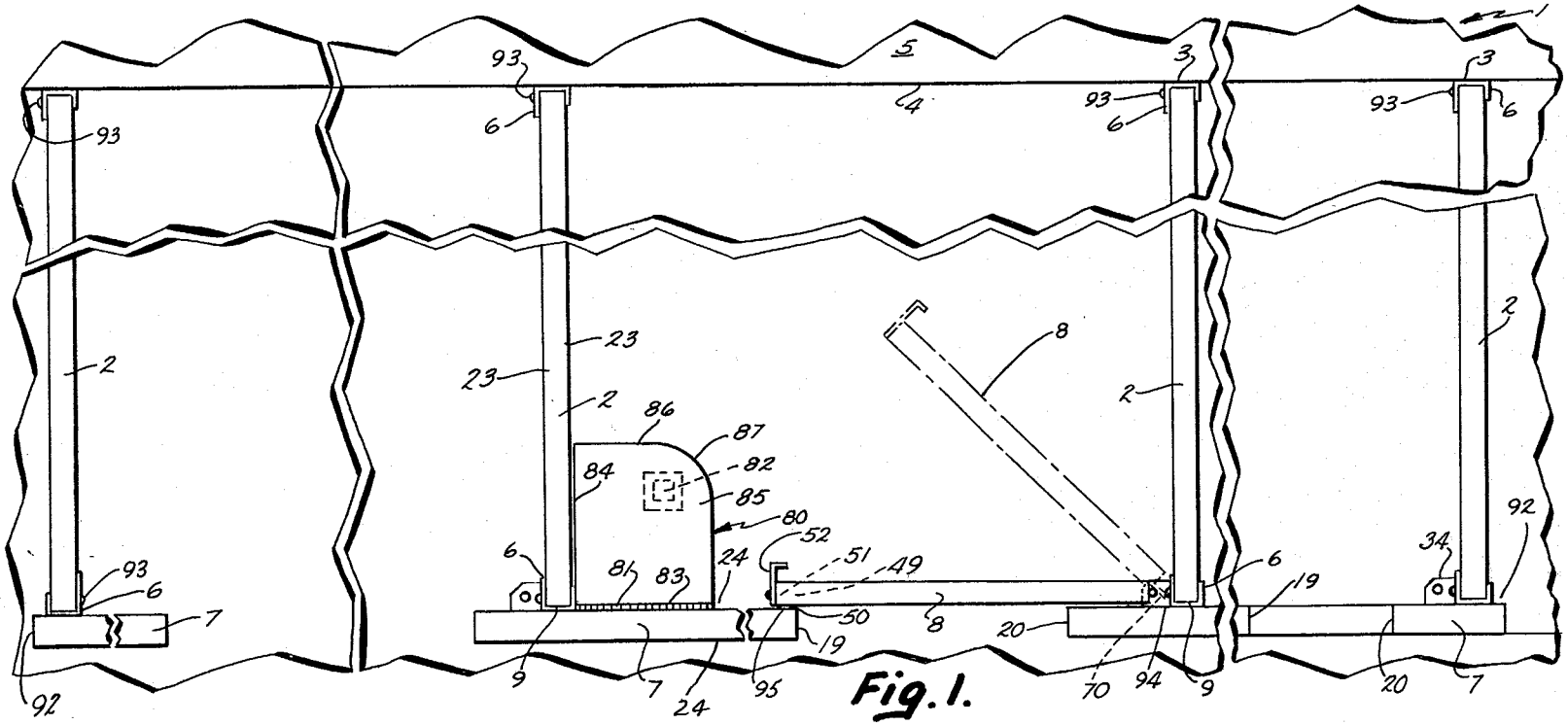
FIG. 1 is a fragmentary, top plan view of a prefabricated partition arrangement embodying the present invention, with a cornis member thereof removed to better view the structure.
Figure 11:
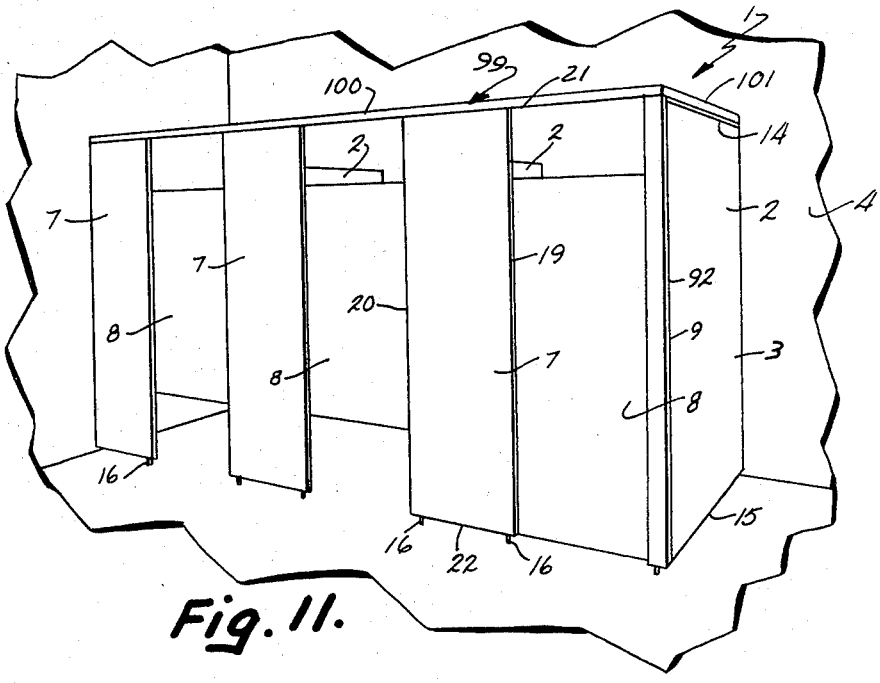
FIG. 11 is a perspective view of the partition arrangement, shown erected in a corner area of a building.

For purposes of description herein, the terms "upper", "lower", "right", "left", "rear", "front", "vertical", "horizontal", and derivatives thereof shall relate to the invention as oriented in FIGS. 1 and 11. However, it is to be understood that the invention may assume various alternative orientations, except where expressly specified to the contrary.

The reference numeral 1 (FIG. 1) generally designates a prefabricated partition arrangement embodying the present invention, which is particularly adapted for fitting rooms, booths, and other similar structures. The partition arrangement 1 comprises a pair of parallel, laterally spaced side panels 2 having rearward edges 3 fastened to an interior wall 4 of a building 5 by a first pair of channels 6. A series of front panels 7 with doors 8 therebetween extend across the forward edges 9 of side panels 2, and are connected thereto by a second channel 6, thereby forming a sturdy, postless partition assembly. The series of panels 7 can be thought of in the broader aspects of the invention as a single front panel with spaced door openings.

The side and front panels 2 and 7 are flat, rigid, rectangularly shaped sections of sheet material. Although the panels 2 and 7 may be constructed of metal, the illustrated embodiment is preferably constructed of a suitable nonmetallic material, such as plywood, particle board, and the like. Preferably, each of the side panels 2 is substantially identical in shape, as are the front panels 7, such that the partition arrangement 1 can be assembled in a modular fashion, using a minimum number of different parts. In this example, the front panels 7 are somewhat thicker than the side panels 2 for extra rigidity as described in greater detail hereinafter.

As best illustrated in FIG. 11, side panels 2 include an upper edge 14, and a lower edge 15. The opposite side and end edges 3 & 9 and 14 & 15 are mutually parallel with adjacent edges disposed perpendicularly, to form a substantially rectangular shape with the longer edges positioned vertically.

The front panels 7 (FIG. 5) are also substantially rectangular in shape, and include side edges 19 and 20 and end edges 21 and 22 respectively. A pair of adjustable feet 16 are connected with the front panel along the lower edge 22 thereof at opposite sides of the panel to support the same above the floor. As shown in FIG. 6, adjustable feet 16 are attached to the front panels by an L-shaped bracket 17, with the vertical flange of the bracket disposed on the inside surface of front panel 7. In this manner, the brackets 17 are hidden from external view, and the outside surface of the front panels 7 remains flat and uncluttered. In the arrangement illustrated in FIG. 11, the side panels 2 are wider than the front panels 7. However, the desired shape of the enclosed area dictates these dimensions. As shown in FIG. 1, both the side and front panels 6 and 7 are preferably flat, with parallel planar faces 23. However, it is to be understood that during use, the panels 2 and 7 may become warped or otherwise deformed such that the side edges of the panel are no longer straight and have a bowed or wavy configuration.

Figure 2:
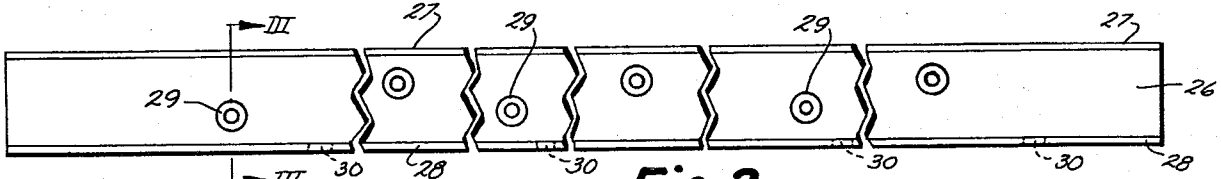
FIG. 2 is a fragmentary, front elevational view of a channel member of the partition arrangement.
Figure 4:
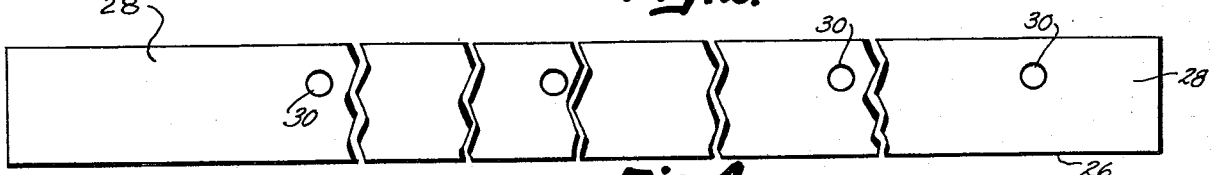
FIG. 4 is a fragmentary side elevational view of the channel, taken from the side of the largest channel flange.
Figure 3:
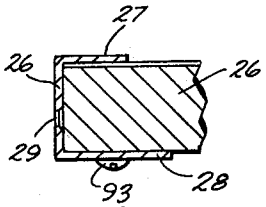
FIG. 3 is a cross-sectional view of the channel taken along the line III—III, FIG. 2, shown attached to a fragmented panel.

As best illustrated in FIGS. 2–4, the channels 6 have a U-shaped transverse cross section, and include a web 20 with two flanges 27 and 28 projecting therefrom. The flanges 27 and 28 are spaced apart a distance slightly greater than the thickness of the side panels 2, so that they are capable of receiving warped or otherwise deformed panel edges between the flanges. Channel web 26 includes a plurality of countersunk apertures 29 therethrough which are spaced apart along the length of the channel in a staggered pattern to facilitate attaching the channel to an adjacent support member. A second set of apertures 30 are positioned through channel flange 28, and extend along the length thereof in a regularly spaced apart fashion. Channel flange 27 does not include any apertures, and presents a smooth, continuous outer surface. As best shown in FIG. 3, channel 6 has an asymmetrical lateral cross-sectional shape, with channel flange 28 wider than channel flange 27 to provide a unique appearance when connected with the panels 2 and 7, as described in greater detail hereinafter. It is to be understood that channel 6 may be alternately constructed with a symmetrical cross section (not shown), with both legs having a length equal to the longest leg of the asymmetrical configuration. Such a structure may be required when wall conditions are abnormally out of plumb, thereby causing the panel to be inclined severely in the channel in a manner that the panel edge is not completely covered. In very extreme or special cases it might also be necessary to increase the length of the channel legs to cope with specific conditions. The channels 6 are constructed of a sturdy, rigid material, such as steel or extruded aluminum. Channels 6 are adapted for vertical orientation, and the smaller channel web 27 is preferably faced outwardly at the exterior ends of the partition assembly. The channels 6 have a length which is sufficient to extend along at least a major portion of the panel side edge to which it is connected, and preferably extends continuously along the entire panel side edge. In this manner, if a gap exists between the side edge of the panel and the member to which it is to be connected, as a result of unlevel floors, unsquare walls, and the like, the channels will cover the gap to provide a neat, finished appearance.

Figure 5:
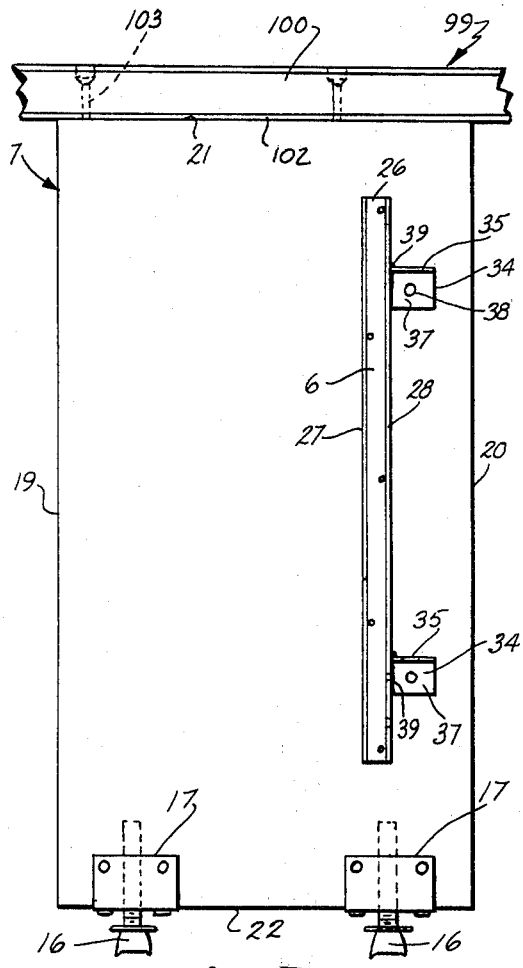
FIG. 5 is an elevational view of a front panel portion of the arrangement, with adjustable feet, and a channel with attached hinges connected therewith.
Figure 6:
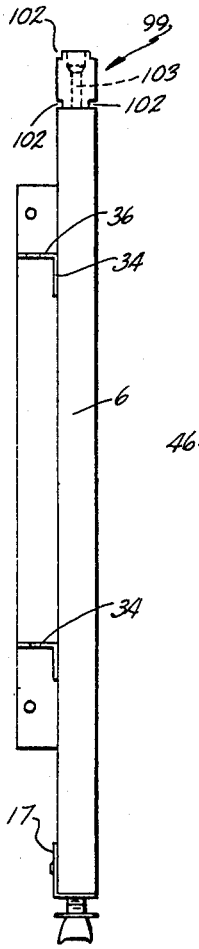
FIG. 6 is a side elevational view of the panel assembly shown in FIG. 5.
Figure 7:
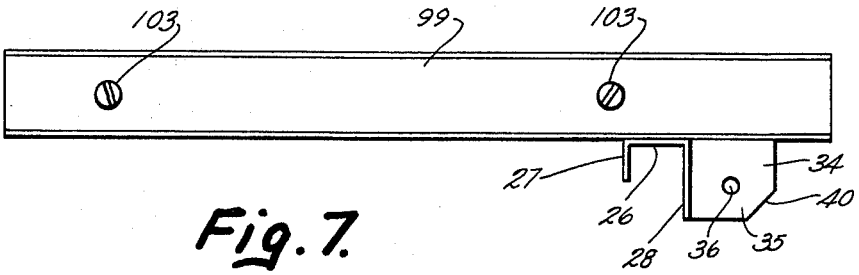
FIG. 7 is an enlarged, top plan view of the panel assembly shown in FIG. 5.

With reference to FIGS. 5–7, the channels 6 may be provided with a pair of hinged brackets 34 to facilitate pivotally connecting door 8 with the partition arrangement. The illustrated hinge brackets 34 are L-shaped, and comprise a top plate 35 with a vertically disposed hinge pin aperture 36 (FIG. 7) therein, and a side plate 37 integrally formed therewith, and including a horizontally oriented aperture 38 disposed at a medial portion thereof. The interior side edges of hinge plates 35 and 37 are fixedly attached to the exterior surface of the wider channel flange 28 by means such as welds 39, which retain the hinge bracket in a substantially perpendicular relationship therewith. The outermost edge 40 (FIG. 7) of the hinge bracket top plate 35 is cut across the corner along a diagonal to provide additional clearance to allow door 8 to swing on the bracket. The hinge brackets 34 are vertically spaced apart a distance which mates with the hinge mounting means on the door 8, as described more fully below.

Figure 8:
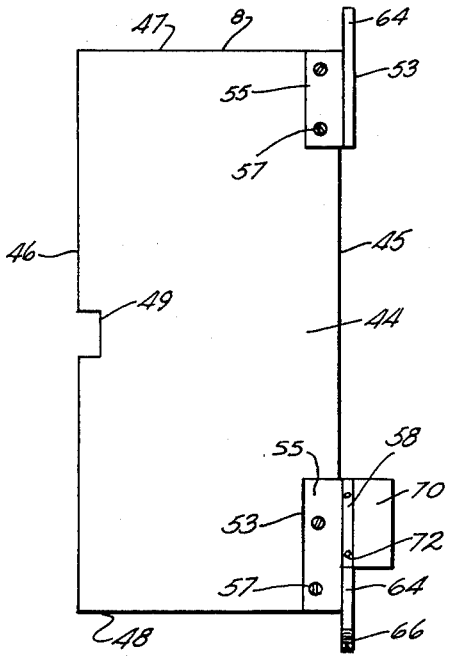
FIG. 8 is an elevational view of a door and hinge assembly for the partition arrangement.

As best shown in FIG. 8, door 8 is of a slab construction, having flat, parallel side faces 44. The door includes interior and exterior side edges 45 and 46 respectively, which are parallel and spaced apart a distance greater than the opening in which the door is to be mounted. The upper and lower end edges 47 and 48 of the door are also parallel, and are spaced apart a distance less than the vertical height of the opening in which the door is positioned. The illustrated door has a substantially rectangular shape, with a notch 49 in the exterior side edge 46 at a medial portion thereof. A latch 50 (FIG. 1) is attached to the door to selectively retain the same in a closed position. The illustrated latch 50 includes a magnetic member 51 positioned within door notch 49, and a bracket member 52 which is fastened to the exterior edge of the door to hold the magnetic member in position therein. Bracket member 52 extends rearwardly from the inside surface of door 8, and includes an L-shped end oriented toward the hinged side of the door to form a handle which can be grasped by the user from inside the fitting room. The depth of notch 49 is smaller than the overlap between door 9 and the adjacent panel, such that when the door is closed, latch 50 is not visible from the front of the partition arrangement.

Figure 9:
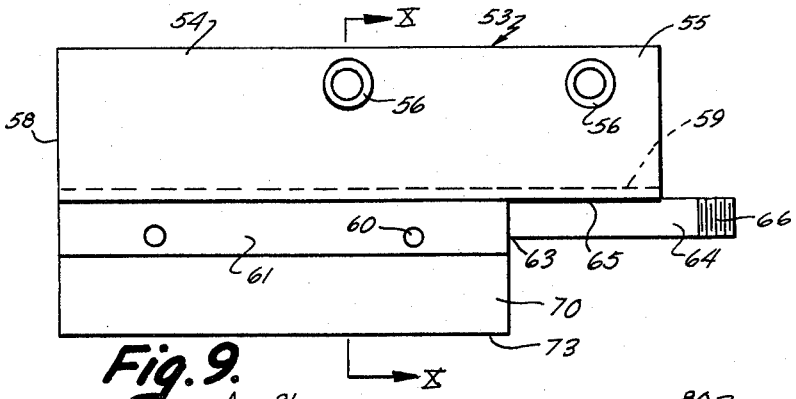
FIG. 9 is an enlarged side elevational view of a hinge portion of the arrangement.
Figure 10:
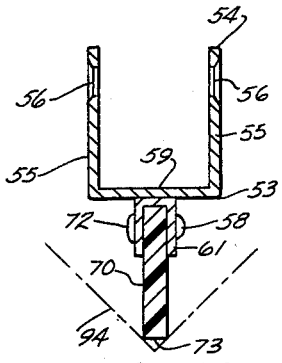
FIG. 10 is a cross-sectional view of the hinge portion, taken along the line X—X, FIG. 9.

A pair of hinges 53 (FIG. 8) are connected at the opposite ends of the interior side edge 44 of door 8. As best illustrated in FIGS. 9 and 10, both of the hinges 53 include a U-shaped channel 54 with opposing flanges 55 between which the door panel is received. Both of the flanges 55 includes a pair of laterally extending, counter-sunk apertures 56 in which fasteners 57 (FIG. 8) are received to attach the hinge to the door panel. A smaller U-shaped channel 58 (FIGS. 9 and 10) is attached to a medial portion of the web 59 of channel 54, and is oriented in an opposite direction thereto. Channel 58 includes a pair of fastener apertures 60 disposed laterally through the opposing flanges 61 thereof for purposes to be described in greater detail hereinafter.

The narrower channel 58 (FIG. 9) is shorter than channel 54, and has one end thereof positioned at the inwardmost end of channel 54, so as to form a notch 63 at the outer end of the hinge. A hinge pin 64 is connected with each hinge on the exterior side of web 59 by suitable means, such as weld 65, and extends longitudinally thereof in an aligned fashion with the channels 54 and 58. The terminal end 66 of hinge pin 64 is disposed a spaced apart distance from the outside adjacent end of channel 54. As shown in FIG. 8, the pin 64 of the lower hinge 53 is preferably shorter than the pin of the upper hinge, and end 66 is threaded to facilitate installation.

A flexible resilient tab 70 (FIG. 8) has one portion thereof connected with door 8 along the inside edge 45 thereof, and an opposite portion anchored in a stationary fashion in the partition arrangement. Tab 70 is elastically deformable in the nature of a leaf spring, and is disposed in a position wherein the resiliency of the tab urges and normally retains door 8 in a predetermined angular position with respect to the mating access opening. In the illustrated structure, tab 70 comprises a length of resilient material, constructed of a synthetic resin, rubber, or the like, with one side edge 71 (FIG. 10) positioned between flanges 61 of channel 58, and securely retained therein by suitable fasteners, such as pop rivets 72 extending through channel apertures 60. One material which has proven satisfactory for tab 70 is a urethane with a hardness in the nature of Shore A, 70. The free side edge 73 of tab 70 is adapted to be captured in a corner formed by adjacent, intersecting side and front panels, as schematically shown by the phantom lines in FIG. 10, to normally retain the door in an partially open position. As best shown by the phantom lines in FIG. 1, the tab 70, hinge pin 64 and hinge plate 34 are arranged with the side and front panels 2 and 7, so that door 8 is normally retained at an angle of approximately 45° to the plane of the door opening. In this example only the lower hinge is provided with a tab 70. However, it is to be understood more than one tab may be used to achieve the desired return action on the door.

Figure 12:
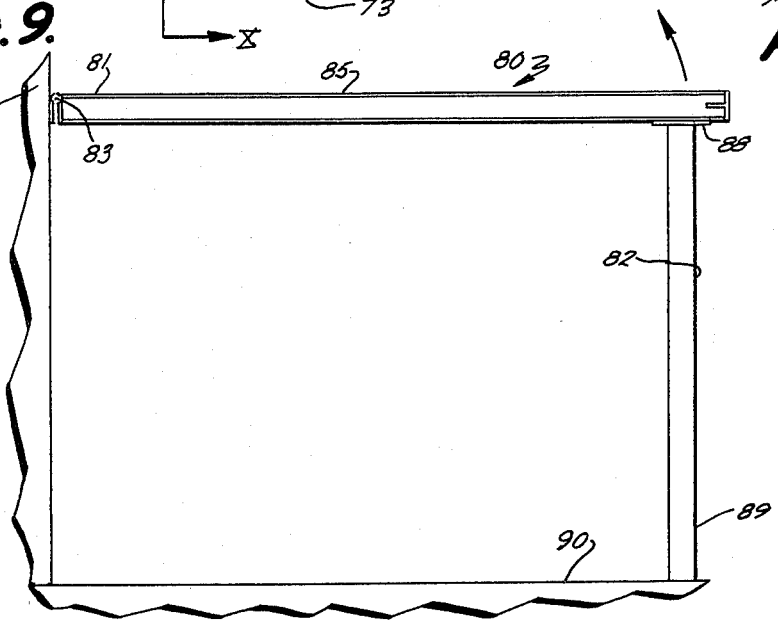
FIG. 12 is a side elevational view of a hinged seat for the partition arrangement.

With reference to FIGS. 1 and 12, the illustrated partition arrangement 1 includes a seat 80 having one edge thereof 81 hingedly connected with one of the partition panels. Seat 80 includes a pedestal 82 which depends from a lower surface thereof at a point spaced apart from edge 81, such that the seat is securely supported by pedestal 82 in a sitting position, and may be raised to a folded position for cleaning under the seat. In this example, a piano hinge 83 connects the forward edge 81 of seat 80 with a front panel 7 in the forwardmost, left-hand corner of the partitioned area (as viewed in FIG. 1). The adjacent rear seat edge 84 is also linear, and is positioned adjacent to the interior face 23 of side panel 2, such that seat 80 may be pivoted upwardly without interference between the seat and the adjacent side panel. The upper surface 85 of seat 80 is adapted for sitting upon, and the exposed seat edge 86 has an arcuately shaped corner 87. Pedestal 82 is located at a point substantially coincident with the center of curvature of seat corner 87. As best illustrated in FIG. 12, the upper end of pedestal 82 is attached to the lower surface of seat 80 by a plate 88. The lower end 89 of pedestal 82 is adapted for abutment with the floor 90 of the partitioned area, and support seats 80 in a substantially horizontal orientation. Hinge 83 is located at an elevation substantially coplanar with the upper surface 85 of seat 80, such that the seat may be bodily rotated upwardly (in a counter-clockwise direction as viewed in FIG. 12), until the seat assumes a substantially vertical orientation, thereby providing free access to the floor area which is normally disposed directly underneath the seat.

A partition arrangement is constructed by first attaching the channels 6 to adjacent support members in a predetermined configuration. In the arrangement illustrated in FIG. 1, the partition panels are interconnected to form three separate dressing rooms or booths. Four side panels and four front panels are required to construct the illustrated arrangement. Initially, four channels 6 are connected with the inside surface of building wall 4 by suitable fasteners, such as screws which extend through the apertures 29 in the channel web. The channels 6 are attached to wall 4 in a vertical orientation, and are spaced apart a distance which is coextensive with the selected width of the dressing rooms. The channels 6 at the extreme ends of the partition arrangement are oriented with the smaller flange 27 directed outwardly. The front panels 7 are positioned front face down on the floor in front of and in alignment with the mating rear channels 6. Channels 6 are then connected with each of the front panels 7 to form an aligned pair with the corresponding rear channels. The front panels located at the extreme ends of the fitting rooms have the associated channels 6 attached thereto at a position which is inset slightly (in the nature of $\frac{3}{4}$ on an inch) from the side edge of the front panel to form a frame or ledge 92. The channels 6 connected with the intermediate front panels 7 are located at a position spaced slightly inwardly from the left-hand side edge 20 of the front panel (as viewed in FIG. 1), so as to allow room for attaching door 8 to the structure. Each of the channels 6 is fixedly attached to the associated front panel by suitable means, such as threaded fasteners extending through apertures 29. The channels 6 in the right-hand corner of each of the dressing rooms (as illustrated in FIG. 1) are each provided with a pair of vertically spaced hinge brackets 34, which have the vertical plate portion 37 thereof also fixedly attached to the associated front panels 7 by fasteners extending through apertures 38.

Side panels 2 are then positioned on their sides in each of the forward channels 6, with the forward panel edges 9 positioned between the channel flanges 27 and 28. Since the channel flanges 27 and 28 are spaced apart a distance wider than the thickness of the side panels, the edge of each panel is readily received in the channel even if the panel edge is bowed or wavy. Threaded fasteners 93 such as pan head screws are inserted through the apertures 30 in channel flange 28, and draw the panels securely against the wider channel side flange 28. Since the fasteners pull the panel to one side of the channel, if the side edge of the channel is warped or otherwise distorted, the attachment of the panel into the channel tends to straighten out the side edge to present a neat appearance. Also, the side flanges of channels 6 do not get drawn in to give a scalloped appearance to the side flanges.

Each of the front panels with associated side panels connected therewith is individually raised to an upright position by pivoting the assembly about the lower front panel edge. The panels are then aligned, and the rearward edge 3 of each side panel 2 is positioned between the channel flanges 27 and 28, and connected therewith by fasteners 93. The feet 16 are then adjusted to insure that the panels are substantially level. In this position, the side panels 2 are substantially parallel, and the front panels 7 are aligned. The side edges 19 and 20 of the front panels form openings in which doors 8 are mounted, as described below.

The doors 8 are mounted in each opening of the partition assembly by initially positioning the door at an angle of approximately 45° to the corner in which the hinged channel member 6 is located. The upper hinge pin 64 is inserted upwardly through the mating aperture 36 in hinge bracket 34, and the door 8 is then bodily lowered in a manner such that the lower hinge pin 64 extends through the lower hinge bracket aperture 36. The lower inside corner of the door panel and the outside ends of hinge channel 54 are abuttingly and pivotally supported on plate 35 of the lower hinge bracket. A lock nut (not shown) is attached to the lower, threaded hinge pin end 36 to securely mount the door in the hinges. Simultaneous with the insertion of the hinge pins 64 in the associated brackets 34, resilient tab 70 is positioned between the adjacent and intersecting side and front panels forming the corner 94 in which the hinged channel is located. The length of tab 70 is such that it is captured in corner 94, and thereby anchored against rotational movement with respect to door 8. The door 8 and tab 70 normally assume a substantially colinear relationship, such that the tab normally holds the door in a half open position, at an angle of approximately 45°. When the door is swung in either direction from this normal position, such as by fully opening or fully closing the door, tab 70 is resiliently bent, thereby creating a spring force which urges the door to its normal position. In the structure illustrated in FIG. 11, the length of the door mounted in the fitting room located furthest from the corner of the room is full length, and extends adjacent the floor to provide additional privacy for the occupants. The remaining doors are of a three-quarter length to provide reduced cost and smoother operation.

In the closed position (FIG. 1) the outside edge 46 of door 8 extends beyond the side edge 19 of the front panel forming the opening. A ferromagnetic striker plate 95 is attached to the inside surface of the front panel adjacent the door opening and abuttingly mates with magnetic latch 50. There is sufficient attraction between magnet 51 and striker plate 95 to securely hold the door closed against the resilient force of tab 70. Because the door is of a slab construction, and is mounted wholly on the interior of the fitting rooms, the precise alignment of the front panels 7 forming the door opening is not crucial to the smooth operation of the door. Nor do nonparallel side edges on the front panels significantly detract from the appearance of the partition arrangement.

Seats 85 are installed in the partition arrangement by attaching hinge 83 to the inside surface of the selected front panel 7. The hinge is located at an elevation which is slightly higher than the length of pedestal 82, such that when the seat is lowered into the sitting position, it assumes a substantially horizontal orientation.

As best shown in FIGS. 5, 6 and 11, the illustrated partition arrangement includes a cornice 99 with one segment 100 extending along the upper edges 21 of each of the front panels 7 and a second segment 101 extending along the upper edge 14 of the end side panel 2. Both cornice segments 100 and 101 have a longitudinal notch at each corner thereof to form attractive reveal 102. Suitable fasteners 103 extend vertically through the cornice segments and attach the same with the adjacent panel edge. Preferably, the cornice segments 100 and 101 are, or at least have the appearance of being one-piece to neatly trim the top of the partition. As shown in FIG. 11, cornice segment 100 is positioned flush with the side faces of the front panels, and forms a header piece across each door opening to impart a fully framed appearance to the assembly. The end cornice segment 101 is spaced outwardly from the end side panel face to mate with the edge 92 and create a slightly protruding border which serves to disguise any warping or misalignment of end panel 2.

In operation, doors 8 are normally retained in a partially open position, at an angle of approximately 45° by resilient tabs 70. In this manner, those seeking to gain access to the fitting rooms may easily observe whether or not any one of the rooms is occupied. After the user has entered the fitting room, he rotates the door to the closed position by overcoming the spring force of tab 70, and magnetic latch 50 holds the door closed. The user may sit on seat 85 during the fitting operation to alleviate fatigue. To exit from the fitting room, the user simply grasps catch handle 52, pulls the door fully open thereby breaking the magnetic attraction between magnet 51 and plate 95, and walks through the door opening into the room. When the door is released, resilient tab 70 automatically and positively returns the door to the partially open position, as shown by the phantom lines in FIG. 1.

The channels 6 permit the user to construct an attractive partition arrangement with plane, flat panels so as to form a sturdy partition assembly without any corner posts. The asymmetrical design of the channels presents an unobtrusive trim edge on the short side of the channel and provides a suitable fastening surface on the other side. By drawing the panel up against only one side of the channel, the creation of a scalloped look at the channel side walls is avoided. The door hinge and resilient tab arrangement provides a mechanism for automatically and positively returning the door to a partially open position, and includes an uncomplicated design which requires little, if any maintenance. The slab door and mounting arrangement therefor permit the door to be easily hung without requiring accurate initial alignment and/or continuous readjustment. The pivotally mounted seat provides an arrangement which is both comfortable for the user and does not interfere with cleaning procedures.

In the foregoing description, it will be readily appreciated by those skilled in the art that many modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A prefabricated partition arrangement for fitting rooms and the like, comprising:

a pair of side panels having rearward edges thereof adapted for placement adjacent a wall; said side panels being laterally spaced apart, extending outwardly from the wall in a substantially parallel relationship, and including forward edges;

a front panel extending between the forward edges of said side panels to partition off an area between said panels and the building wall; said front panel including an opening therein to permit access to the partitioned area, and means for selectively closing said opening;

a first pair of channels extending along a major portion of the side panel forward edges and positioned between the same and said front panel; said channels having a web portion fastened to said front panel, and a pair of flanges between which said side panel forward edges are received;

a second pair of channels extending along a major portion of the side panel rearward edges and positioned between the same and the wall; said second pair of channels having a web portion shaped for fastening to the wall, and a pair of flanges between which said side panel rearward edges are received;

said flanges of said first and second pairs of channels being spaced apart a distance greater than the thickness of said panel edges received therebetween to accommodate for panel warpage and other similar deformation; said channels being asymmetrical, with an interior one of said flanges longer than an exterior one of said flanges;

means for fastening said side panels with the associated pair of channels, thereby forming a rigid, postless partition assembly; said fastening means comprising fasteners which extend through and along only the longer, interior channel flange, and drawing the associated panel edge against the same, so as to present a neat, straight edge.

2. A partition arrangement as set forth in claim 1, including:

a first pair of hinge brackets formed integrally on the channel disposed adjacent the inside edge of the door.

3. A partition arrangement as set forth in claim 2, including:

a second pair of hinge brackets connected with the door along the inside edge thereof, and including pins; and wherein said first hinge brackets include vertically disposed apertures therein in which said pins are received for pivotally connecting the door with said one front panel.

4. A partition arrangement as set forth in claim 3, wherein:

said pins extend in opposite directions, with a lower one of the pins being shorter than an upper one of the pins to facilitate inserting said pins into the bracket apertures.

5. A partition arrangement as set forth in claim 4, wherein:

fastening means on the free end of said lower pin to prevent inadvertently dislodging the pins from the brackets.

6. A partition arrangement as set forth in claim 5, wherein:

said front panel comprises two separate panels having adjacent side edges thereof spaced apart to form said opening.

7. A partition arrangement as set forth in claim 6, wherein:

said front panels are substantially identical in shape such that said partition arrangement is modular; and said front panels are connected along one side thereof with the forward edge of one side panel at a point spaced inwardly from the front panel side edge so as to form an overlap area in which said hinge brackets are disposed; the other side of said front panels extending to a point where said door laps over the adjacent front panel side edge.

8. A partition arrangement as set forth in claim 7, wherein:

said front panels have a substantially rectangular shape.

9. A partition arrangement as set forth in claim 8, wherein:

said front panels and said doors are each constructed from a slab of sheet material.

10. A partition arrangement as set forth in claim 9, wherein:

said front panels have a face between the attached side panel and the free end of the door which is sufficiently wide to mount a seat therealong.

11. A partition arrangement as set forth in claim 10, including:

a seat hingedly mounted on the inside surface of said front panel face.

12. A partition arrangement as set forth in claim 11, wherein:

said seat includes a depending pedestal, with the lower end thereof adapted for abutment with a supporting surface for retaining the seat in a sitting position.

13. A partition arrangement as set forth in claim 12, including:

a flexible and resilient tab having one portion connected with the inside edge of said door, and an other portion of said tab being anchored in a position wherein said tab resiliently urges and normally retains said door in an open position.

14. A partition arrangement as set forth in claim 13, wherein:

said tab other portion is positioned in a corner formed between the adjacent front and side panels, and is captured therebetween.

15. A partition arrangement as set forth in claim 14, wherein:

said tab one portion is mounted in one of said second hinge brackets.

16. A partition arrangement as set forth in claim 15, wherein:

said front panel has an outer side edge positioned at an exposed end of the partition arrangement; and one of said side panels is positioned at the exposed end of said partition arrangement; said forward edge of said one side panel is inset from the outer edge of said front panel to present a neat appearance.

17. A partition arrangement as set forth in claim 16, including:

a cornice connected with the upper edges of said panels.

18. A partition arrangement as set forth in claim 1, including:

a flexible and resilient tab having one portion connected with an inside edge of said closing means, and an other portion of said tab anchored in a position wherein said tab resiliently urges and normally retains said door in an open position.

19. A partition arrangement as set forth in claim 18, wherein:

said tab other portion is positioned in a corner formed between the adjacent front and side panels, and is captured therebetween.

20. A partition arrangement as set forth in claim 19, wherein:

said one side panel includes a portion of said cornice which projects outwardly over the upper edge of the one side panel to form a framed appearance with the protruding outer side edge of said front panel.

21. A partition arrangement as set forth in claim 20, wherein:

said front panel is thicker than said side panels.

22. A partition arrangement as set forth in claim 1, wherein:

said front panel comprises two separate panels having adjacent side edges thereof spaced apart to form said opening.

23. A partition arrangement as set forth in claim 22, wherein:

said closing means comprises a door hingedly mounted on the interior side of one of said front panels, and having a width which extends laterally across said opening and laps over the side edge of the other front panel on the interior face thereof to present a neat appearance without precise fitting of the door.

24. A prefabricated partition arrangement for fitting rooms and the like, comprising:

a pair of side panels having rearward edges thereof adapted for placement adjacent a wall; said side panels being laterally spaced apart, extending outwardly from the wall in a substantially parallel relationship, and including forward edges;

a front panel extending between the forward edges of said side panels to partition off an area between said panels and the building wall; said front panel including an opening therein to permit access to the partitioned area, and means for selectively closing said opening;

a first pair of channels extending along a major portion of the side panel forward edges and positioned between the same and said front panel; said channels having a web portion fastened to said front panel, and a pair of flanges between which said side panel forward edges are received;

a second pair of channels extending along a major portion of the side panel rearward edges and positioned between the same and the wall; said second pair of channels having a web portion shaped for fastening to the wall, and a pair of flanges between which said side panel rearward edges are received;

means for fastening said side panels with the associated pair of channels, thereby forming a rigid, postless partition assembly;

said closing means comprising a door hingedly mounted on the interior side of said front panel; and a first pair of hinge brackets formed integrally on the channel disposed adjacent the inside edge of said door for pivotally supporting said door thereon.

25. A partition arrangement as set forth in claim 24, including:

a second pair of hinge brackets connected with the door along the inside edge thereof, and including pins; and wherein said first hinge brackets include vertically disposed apertures therein in which said pins are received for pivotally connecting the door with said one front panel.

26. A partition arrangement as set forth in claim 25, wherein:

said pins extend in opposite directions, with a lower one of the pins being shorter than an upper one of the pins to facilitate inserting said pins into the bracket apertures.

27. A partition arrangement as set forth in claim 26, including:

fastening means on the free end of said lower pin to prevent inadvertently dislodging the pins from the brackets.

28. A partition arrangement as set forth in claim 27, wherein:

said front panels are substantially identical in shape such that said partition arrangement is modular; and said front panels are connected along one side thereof with the forward edge of one side panel at a point spaced inwardly from the front panel side edge so as to form an overlap area in which said hinge brackets are disposed; the other side of said front panels extending to a point where said door laps over the adjacent front panel side edge.

29. A partition arrangement as set forth in claim 28, wherein:

said front panels have a substantially rectangular shape.

30. A partition arrangement as set forth in claim 29, wherein:

said front panels and said doors are each constructed from a slab of sheet material.

31. A partition arrangement as set forth in claim 28, wherein:

said front panels have a face between the attached side panel and the free end of the door which is sufficiently wide to mount a seat therealong.

32. A partition arrangement as set forth in claim 31, including:

a seat hingedly mounted on the inside surface of said front panel face.

33. A partition arrangement as set forth in claim 21, wherein:

said seat includes a depending pedestal, with the lower end thereof adapted for abutment with a supporting surface for retaining the seat in a sitting position.

34. A partition arrangement as set forth in claim 33, including:

a flexible and resilient tab having one portion connected with the inside edge of said door, and an other portion of said tab being anchored in a position wherein said tab resiliently urges and normally retains said door in an open position.

35. A partition arrangement as set forth in claim 34, wherein:

said tab other portion is positioned in a corner formed between the adjacent front and side panels, and is captured therebetween.

36. A partition arrangement as set forth in claim 35, wherein:

said tab one portion is mounted in one of said second hinge brackets.

37. A partition arrangement as set forth in claim 36, wherein:

said one of said second hinge brackets comprises a pair of oppositely oriented channels, wherein said tab is mounted between flanges of one of the channels, and the door is mounted between flanges of the other channel.

38. A prefabricated partition arrangement for fitting rooms and the like, comprising:

a pair of side panels having rearward edges thereof adapted for placement adjacent a wall; said side panels being laterally spaced apart, extending outwardly from the wall in a substantially parallel relationship, and including forward edges;

a front panel extending between the forward edges of said side panels to partition off an area between said panels and the building wall; said front panel including an opening therein to permit access to the partitioned area, and means for selectively closing said opening;

a first pair of channels extending along a major portion of the side panel forward edges and positioned between the same and said front panel; said channels having a web portion fastened to said front panel, and a pair of flanges between which said side panel forward edges are received;

a second pair of channels extending along a major portion of the side panel rearward edges and positioned between the same and the wall; said second pair of channels having a web portion shaped for fastening to the wall, and a pair of flanges between which said side panel rearward edges are received;

means for fastening said side panels with the associated pair of channels, thereby forming a rigid, postless partition assembly;

said closing means comprising a door hingedly mounted on the interior side of said front panel;

a flexible and resilient tab having one portion connected with an inside edge of said door, and an other portion of said tab positioned in a corner formed between the adjacent front and side panels, and being captured therebetween, whereby said tab resiliently urges and normally retains said door in an open position.

39. A partition arrangement as set forth in claim 38, wherein:

said tab one portion is mounted in one of said second hinge brackets.

40. A partition arrangement as set forth in claim 39, wherein:

said one of said second hinge brackets comprises a pair of oppositely oriented channels, wherein said tab is mounted between flanges of one of the channels, and the door is mounted between flanges of the other channel.

41. A prefabricated partition arrangement for fitting rooms and the like, comprising:

a pair of side panels having rearward edges thereof adapted for placement adjacent a wall; said side panels being laterally spaced apart, extending outwardly from the wall in a substantially parallel relationship, and including forward edges;

a front panel extending between the forward edges of said side panels to partition off an area between said panels and the building wall; said front panel including an opening therein to permit access to the partitioned area, and means for selectively closing said opening;

a first pair of channels extending along a major portion of the side panel forward edges and positioned between the same and said front panel; said channels having a web portion fastened to said front panel, and a pair of flanges between which said side panel forward edges are received;

a second pair of channels extending along a major portion of the side panel rearward edges and positioned between the same and the wall; said second pair of channels having a web portion shaped for fastening to the wall, and a pair of flanges between which said side panel rearward edges are received;

means for fastening said side panels with the associated pair of channels, thereby forming a rigid, postless partition assembly;

said closing means comprising a door hingedly mounted on the interior side of one of said front panels, and having a width which extends laterally across said opening and laps over the side edge of the other front panel on the interior face thereof to present a neat appearance without precise fitting of the door; and a first pair of hinge brackets formed integrally on the channel disposed adjacent the inside edge of the door.

42. A partition arrangement as set forth in claim 41, including:

a second pair of hinge brackets connected with the door along the inside edge thereof, and including pins; and wherein said first hinge brackets include vertically disposed apertures therein in which said pins are received for pivotally connecting the door with said one front panel.

43. A partition arrangement as set forth in claim 42, wherein:

said pins extend in opposite directions, with a lower one of the pins being shorter than an upper one of the pins to facilitate inserting said pins into the bracket apertures.

44. A partition arrangement as set forth in claim 43, including:

fastening means on the free end of said lower pin to prevent inadvertently dislodging the pins from the brackets.

45. A partition arrangement as set forth in claim 44, wherein:

said front panels are substantially identical in shape such that said partition arrangement is modular; and said front panels are connected along one side thereof with the forward edge of one side panel at a point spaced inwardly from the front panel side edge so as to form an overlap area in which said hinge brackets are disposed; the other side of said front panels extending to a point where said door laps over the adjacent front panel side edge.

46. A partition arrangement as set forth in claim 45, including:

a flexible and resilient tab having one portion connected with the inside edge of said door, and an other portion of said tab being anchored in a position wherein said tab resiliently urges and normally retains said door in an open position.

47. A prefabricated partition arrangement for fitting rooms and the like, comprising:

a pair of side panels having rearward edges thereof adapted for placement adjacent a wall; said side panels being laterally spaced apart, extending outwardly from the wall in a substantially parallel relationship, and including forward edges;

a front panel extending between the forward edges of said side panels to partition off an area between said panels and the building wall; said front panel including an opening therein to permit access to the partitioned area, and means for selectively closing said opening;

a first pair of channels extending along a major portion of the side panel forward edges and positioned between the same and said front panel; said channels having a web portion fastened to said front panel, and a pair of flanges between which said side panel forward edges are received;

a second pair of channels extending along a major portion of the side panel rearward edges and positioned between the same and the wall; said second pair of channels having a web portion shaped for fastening to the wall, and a pair of flanges between which said side panel rearward edges are received;

means for fastening said side panels with the associated pair of channels, thereby forming a rigid, postless partition assembly;

said closing means comprising a door hingedly mounted on the interior side of said front panel, and having a width which extends laterally across said opening and laps over the side edge of said front panel on the interior face thereof to present a neat appearance without precise fitting of the door;

a flexible and resilient tab having one portion connected with the inside edge of said door, and an other portion of said tab being positioned in a corner formed between the adjacent front and side panels, and being captured therebetween, whereby said tab resiliently urges and normally retains said door in an open position.

48. A partition arrangement as set forth in claim 47, wherein:

said tab one portion is mounted in one of said second hinge brackets.

49. A partition arrangement as set forth in claim 48, wherein:

said tab one portion is mounted in one of said second hinge brackets.

50. A partition arrangement as set forth in claim 49, wherein:

said one of said second hinge brackets comprises a pair of oppositely oriented channels, wherein said tab is mounted between flanges of one of the channels, and the door is mounted between flanges of the other channels.

51. In a prefabricated partition arrangement for fitting rooms and the like having interconnected panels which close off a selected area, and an opening with a hinged door to selectively access the area, the improvement comprising:

a flexible, resilient tab having one end thereof connected with said door adjacent an inside edge thereof; the other end of said tab being anchored in a stationary portion of the partition arrangement in a position wherein the resiliency of said tab urges and normally retains said door in a predetermined angular position with respect to said opening; and wherein said tab other end is captured in a corner formed by adjacent, intersecting panels, for normally retaining the door in a partially opened position.

* * * * *

UNITED STATES PATENT AND TRADEMARK OFFICE

CERTIFICATE OF CORRECTION

PATENT NO. : 4,388,783

DATED : June 21, 1983

INVENTOR(S) : Charles F. Logie

It is certified that error appears in the above-identified patent and that said Letters Patent is hereby corrected as shown below:

Column 4, line 50:
"L-shped" should be --L-shaped--.

Column 12, Claim 33, line 42:
"21" should be --32--.

Signed and Sealed this

First Day of November 1983

[SEAL]

*Attest:*

GERALD J. MOSSINGHOFF

*Attesting Officer*

*Commissioner of Patents and Trademarks*